US005203363A

United States Patent [19]

Kidwell et al.

[11] Patent Number: 5,203,363

[45] Date of Patent: Apr. 20, 1993

[54] PORTABLE CANOPY ATTACHMENT

[76] Inventors: William Kidwell, 1062 Iris Pl., Westbury, N.Y. 11753; MaryAnn Levinson, 10 Tredwell Ave., Syosset, N.Y. 11791

[21] Appl. No.: 713,957

[22] Filed: May 13, 1991

[51] Int. Cl.[5] ..... E04H 15/04

[52] U.S. Cl. ..... 135/90; 135/96; 297/184

[58] Field of Search ..... 135/90, 96, 909, 87; 297/184, 400

[56] References Cited

U.S. PATENT DOCUMENTS 1,480,286 1/1924 Morganstern ..... 135/96 X
2,756,760 7/1956 Grotteria ..... 135/16 X
4,389,057 6/1983 Richard, Jr. ..... 297/184 X
4,643,479 2/1987 Servi ..... 297/184
5,096,257 3/1992 Clark ..... 135/96 X

*Primary Examiner*—Richard E. Chilcot, Jr.
*Assistant Examiner*—Lan M. Mai
*Attorney, Agent, or Firm*—Michael I. Kroll

[57] ABSTRACT

A portable canopy attachment is provided which consists of a support member, in which its lower portion can be inserted within the ground, so that the support member can stand in a generally vertical position. A canopy member is attached to the upper portion of the support member, so that the canopy member can extend outwardly from the support member in a generally horizontal position to cover and protect a person placed onto the ground below the canopy member, such as from the rays of the sun.

6 Claims, 2 Drawing Sheets

PORTABLE CANOPY ATTACHMENT

BACKGROUND OF THE INVENTION

1. Field of the Invention

The instant invention relates generally to coverings and more specifically it relates to a portable canopy attachment.

2. Description of the Prior Art

Numerous coverings have been provided in prior art that are adapted to be rooflike structures which extend over people and objects, so as to protect and conceal the people and objects. While these units may be suitable for the particular purpose to which they address, they would not be as suitable for the purposes of the present invention as heretofore described.

SUMMARY OF THE INVENTION

A primary object of the present invention is to provide a portable canopy attachment that will overcome the shortcomings of the prior art devices.

Another object is to provide a portable canopy attachment for a lawn chair, that will protect a person from the hot summer sun outdoors at the pool, yard, picnic area, beach and the like.

An additional object is to provide a portable canopy attachment for a wheelchair, that will protect disabled and elderly people from the harmful rays of the sun.

A further object is to provide a portable canopy attachment that is simple and easy to use.

A still further object is to provide a portable canopy attachment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 8:
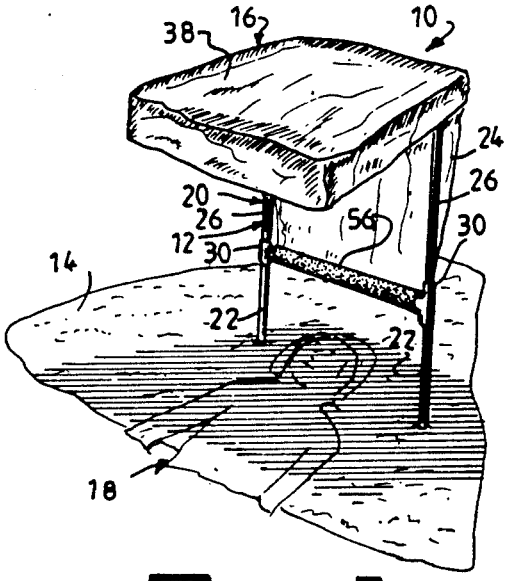
FIG. 8 is a perspective view of the instant invention installed directly into the ground and the canopy cover extending over a portion of a person lying on the ground.

Turning now descriptively to the drawings, in which similar reference characters denote similar elements throughout the several views, the Figures illustrate a portable canopy attachment 10 which consists of a support member 12, in which its lower portion can be inserted within the ground 14, so that the support member 12 can stand in a generally vertical position. A canopy member 16 is attached to the upper portion of the support member 12, so that the canopy member 16 can extend outwardly from the support member 12 in a generally horizontal position to cover and protect a person 18 placed onto the ground 14 below the canopy member 16, such as from the rays of the sun (see FIG. 8).

The support member 12 includes a support frame structure 20 and a pair of legs 22. Each leg 22 is connected in alignment to one corner of the support frame structure 20 in a space apart relationship, so that if the legs 22 are inserted within the ground 14, said support frame structure 20 stand in the generally vertical position. A flexible covering 24 is affixed to the support frame structure 20 to block out the rays of the sun.

The support frame structure 20 includes a pair of spaced apart side rails 26 and a pair of spaced apart cross bars 28 connected to the side rails.

The support frame structure 20 further includes a pair of tee fittings 30 and a pair of ell fittings 32. Each tee fitting 30 connects one leg 22, a lower cross bar 28 and one side rail 26 together. Each ell fitting 32 connects an upper cross bar 28 and one side rail 26 together.

The canopy member 16 includes a canopy frame structure 34 and a pair of arms 36. Each arm 36 is connected in alignment to one corner of the canopy frame structure 34 in a spaced apart relationship, so that when the arms 36 are attached to the upper portion of the support frame structure 20, the canopy frame structure 34 will extend outwardly from the support frame structure 20 in the generally horizontal position. A second flexible covering 38 is affixed to the canopy frame structure 34 and the arms 36 to block out the rays of the sun.

The canopy frame structure 34 includes a pair of spaced apart side rails 40 and a pair of spaced apart cross bars 42 connected to the side rails 40. The canopy frame structure 34 further includes a pair of tee fittings 44 and a pair of ell fittings 46. Each tee fitting 44 connects one arm 36, the inner cross bar 42 and one side rail 40 together. Each ell fitting 46 connects the outer cross bar 42 and one said rail 40 together.

The portable canopy attachment 10 further includes a pair of hinge members 48. Each hinge member 48 is connected between a distal end of one of the arms 36 of the canopy member 16 and one of the ell fittings 32 on the support frame structure 30 of the support member 12. The canopy member 16 can swing back out of its normal horizontal position when not in use for storage and the like.

A mechanism 50 is for removably attaching the distal ends of the legs 22 of the support member 12 to a backrest frame 52 of a chair 54 so that the canopy member 16 can cover and protect a person sitting in the chair 54.

A padded cushion 56 fits over the lower cross bar 28 of the support frame structure 20 so as to be used as a head rest for the person sitting in the chair 54.

Figures 1, 2, 3, 4:
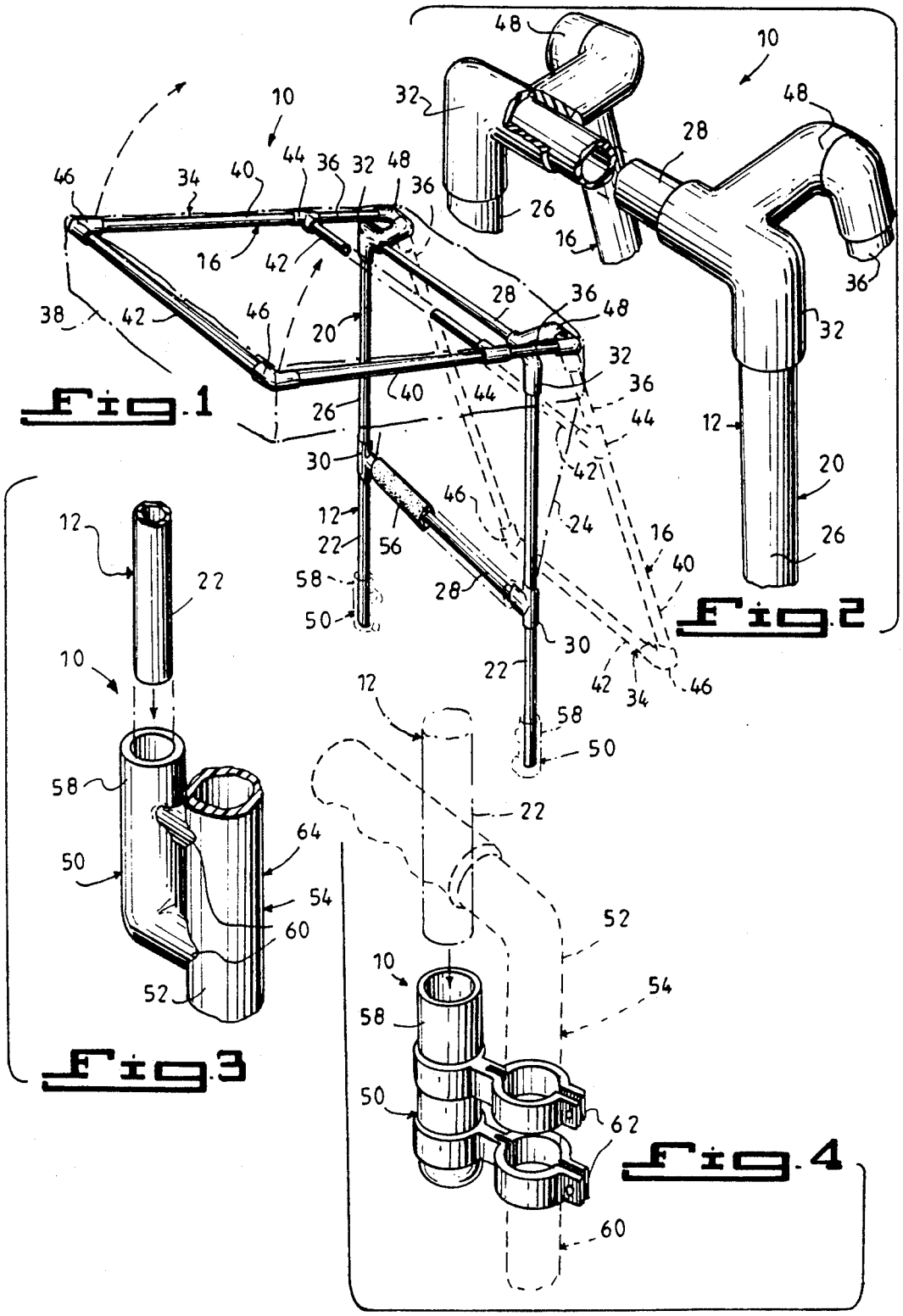
FIG. 1 is a perspective view of the instant invention per se, with parts shown in phantom.
FIG. 2 is an enlarged perspective view of a portion of the instant invention, showing the hinges in greater detail.
FIG. 3 is an enlarged exploded perspective view of a portion of the instant invention, showing a permanent stanchion bracket in greater detail.
FIG. 4 is an enlarged exploded perspective view of a portion of the instant invention, with parts in phantom, showing an attachable stanchion bracket in greater detail.

The removably attaching mechanism 50 includes a pair of receptacles 58, each of which is affixed to one side of the backrest frame 52 of the chair 54. The distal ends of the legs 22 of the support member 12 can be inserted within and removed from the receptacles 58. As best seen in FIG. 3, each receptacle 58 is affixed to one side of the backrest frame 52 of the chair 54 by a permanent attachment 60 thereof. As best seen in FIG. 4, each receptacle 58 is affixed to one side of the backrest frame 52 of the chair 54 by at least one clamp member 62 attached therebetween.

Figure 5:
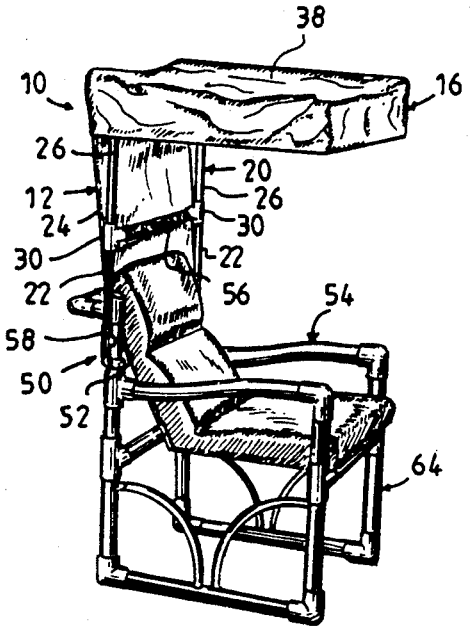
FIG. 5 is a perspective view of a chair with the instant invention installed thereto and the canopy cover extending over the chair.
Figure 6:
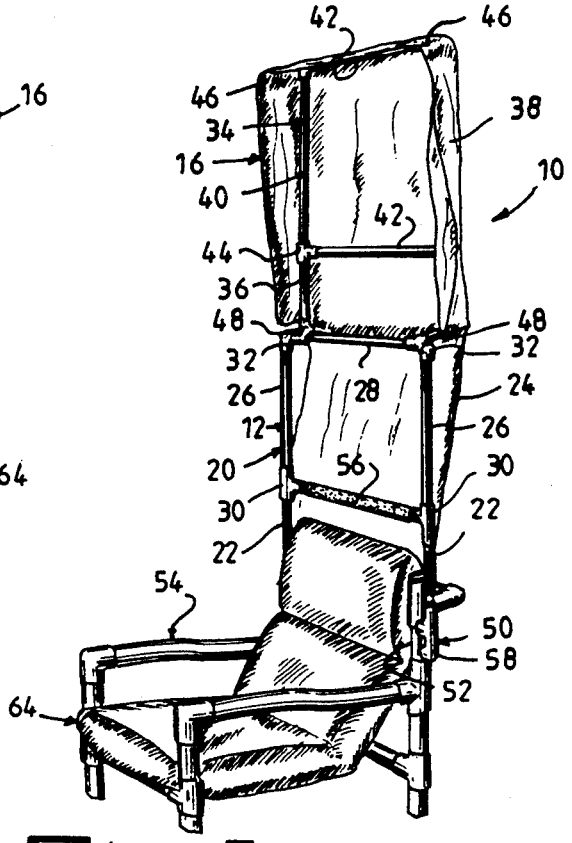
FIG. 6 is a perspective view with parts broken away of the chair, with the instant invention installed thereto and the canopy cover flipped up.
Figure 7:
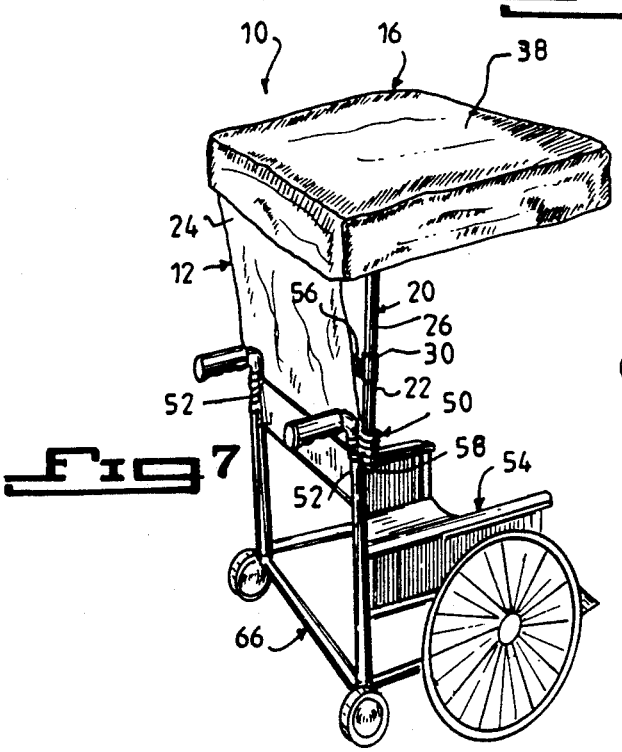
FIG. 7 is a perspective view of a wheel chair with the instant invention installed thereto and the canopy cover extending over the wheelchair.

The chair 54, as shown in FIGS. 5 and 6, can be a typical outdoor lawn chair 64. The chair 54, as shown in FIG. 7, can be a typical wheelchair 66. If the chair 54 is a wheelchair 66, the portable canopy attachment 10 can protect an elderly or handicapped person sitting in the wheelchair 66 from the rays of the sun, which in certain cases can cause some skin cancers.

LIST OF REFERENCE NUMBERS

10: portable canopy attachment
12: support member
14: ground
16: canopy member
18: person
20: support frame structure
22: leg
24: first flexible covering
26: side rail of 20
28: cross bar of 20
30: tee fitting of 20
32: ell fitting of 20
34: canopy frame structure
36: arm
38: second flexible covering
40: side rail of 34
42: cross bar of 34
44: tee fitting of 34
46: ell fitting of 34
48: hinge member
50: removably attaching mechanism
52: backrest frame
54: chair
56: padded cushion
58: receptacle
60: permanent attachment
62: clamp member
64: typical lawn chair
66: typical wheelchair It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable canopy attachment comprises:

A) a support member having an upper portion and a lower portion wherein said lower portion can be inserted in the ground; said support member further includes a) a support frame structure includes corners, a pair of spaced apart side rails, a pair of spaced apart upper and lower cross bars connected to said side rails, and a pair of tee fittings wherein each of said tee fittings connects one of said legs, one of said lower cross bar and one of said side rails together, and a pair of ell fittings wherein each of said ell fittings connects said upper cross bar and one of said side rails together;

b) a pair of legs, each of said legs connected in alignment to one of said corner in a spaced apart relationship, wherein said legs can be inserted in the ground to hold said support frame structure in a generally vertical position; and c) a first flexible covering affixed to said support frame structure to block out the sunrays;

B) a canopy member attached to said upper portion wherein said canopy member can extend outwardly form said support member in a generally horizontal position to cover and protect a person from the sunrays; said canopy member further includes a) a canopy frame structure having corners, a pair of sapaced apart side rails, a pair of spaced apart inner and outer cross bars connected to said side rails, and a pair of tee fittings, each of said tee fittings connects one of said arms, said inner cross bar and one of said side rails together, and a pair of ell fittings, each of said ell fittings connects said outer cross bar and one of said side rails together;

b) a pair of arms, each of said arms connected in alignment to one of said corners of said canopy frame structure in a spaced apart relationship, so that when said arms are attached to said upper portion of said support frame structure, said canopy frame structure will extend outwardly from said support frame structure in a generally horizontal position; and c) a second flexible covering affixed to said canopy frame structure and said arms to block out sunrays;

d) a pair of hinge members, each of said hinge members connected between a distal end of one of said arms of said canopy member and one of said ell fittings on said support frame structure of said support member so that said canopy member can swing back out of the horizontal position for storage.

2. A portable canopy attachment as recited in claim 1, further including means for removably attaching the distal ends of said legs of said support member to a backrest frame of a chair so that said canopy member can cover and protect a person sitting in the chair.

3. A portable canopy attachment as recited in claim 2, further including a padded cushion to fit over said lower cross bar of said support frame structure so as to be used as a head rest for the person sitting in the chair.

4. A portable canopy attachment as recited in claim 3, wherein said removably attaching means includes a pair of receptacles, each of which is affixed to one side of the backrest frame of the chair, so that the distal ends of said legs of said support member can be inserted within and removed from said receptacles.

5. A portable canopy attachment as recited in claim 4, wherein each said receptacle is affixed to one side of the backrest frame of the chair by a permanent attachment thereof.

6. A portable canopy attachment as recited in claim 4, wherein each said receptacle is affixed to one side of the backrest frame of the chair by at least one clamp member attached therebetween.

* * * * *